United States Patent [19]

Yingst et al.

[11] Patent Number: 4,706,466

[45] Date of Patent: Nov. 17, 1987

[54] UNDER THE COUNTER ICE MAKING MACHINE

[75] Inventors: Thomas E. Yingst, Aurora, Colo.; Fredrick A. Weis, Chattanooga, Tenn.

[73] Assignee: Mile High Equipment Company, Denver, Colo.

[21] Appl. No.: 903,392

[22] Filed: Sep. 3, 1986

[51] Int. Cl.[4] ..... F25C 1/04

[52] U.S. Cl. ..... 62/138; 62/302; 62/344; 312/201; 312/257 R

[58] Field of Search ..... 62/344, 347, 298, 302, 62/138; 312/198, 201, 253, 257 R

[56] References Cited

U.S. PATENT DOCUMENTS

| | | | |
|---|---|---|---|
| 2,526,262 | 10/1950 | Munshower | 62/344 X |
| 2,579,379 | 12/1951 | Fritsche | 62/302 X |
| 2,645,910 | 7/1953 | Leeson | 62/347 X |
| 2,722,110 | 11/1955 | Denzer | 62/344 X |
| 2,995,905 | 8/1961 | Ayres et al. | 62/344 |
| 3,289,430 | 12/1966 | Dedricks et al. | 62/347 X |
| 4,341,087 | 7/1982 | Van Steenburgh, Jr. | 62/347 X |
| 4,489,567 | 12/1984 | Kohl | 62/347 X |

*Primary Examiner*—William E. Tapolcai

*Attorney, Agent, or Firm*—Hubbard, Thurman, Turner & Tucker

[57] ABSTRACT

An under the counter ice making machine has a refrigerator for producing ice cube bearing slabs. A freezer compartment support means includes a bottom compartment having a rear panel extending upwardly to a top panel. The evaporator of the refrigerator is attached to the rear panel adjacent to the top panel and the remainder of the refrigerator components are supported in the bottom compartment which has an open top. A separate unitary freezer compartment includes an integrally formed ice bin portion and a top portion. When the freezer compartment is resting on the bottom compartment of the support means the top portion coacts with the evaporator bearing rear wall end to enclose the top portion. Thus, the freezer compartment is slidably mounted on the bottom compartment so that the bottom of the ice bin portion closes the bottom compartment. When the freezer compartment is removed from the bottom compartment, the evaporator means and the remainder of the refrigerator components in the bottom compartment are exposed for maintenance and repair; while the freezer compartment is free for cleaning. The evaporator means located in the freezer top portion includes a vertically disposed ice cube bearing slab mold and an ice cube harvest probe for tumbling the slabs into the ice bin to ensure a substantially full ice bin before shut off. If the refrigerator includes an air cooled condenser, the bottom compartment front panel includes a grille and a fan for forcing air in and out the front to cool the condenser in the compartment.

12 Claims, 11 Drawing Figures

UNDER THE COUNTER ICE MAKING MACHINE

BACKGROUND OF THE INVENTION

This invention relates to ice making machines and more particularly to an improved under the counter ice making machine.

In the past, under the counter ice making machines have included removable houses. The houses from front to back have included access doors hinged at the bottom for accessing ice bins located in ice bin compartments. The ice bins are supported by frames having ends attached to the doors and housings in order that when the doors are opened, the ice bins are pulled out of the bin compartments with the doors for easy bin access. Behind the ice bin compartment rear walls are compressor type refrigerator components such as, for example, the compressors and condensers. Condenser fans are mounted in the ice bin compartment's rear walls for drawing cooled air from the compartments for the condensers. The refrigerator evaporators to which the ice cube molds are attached are located in the ice bin compartments above the ice bins. The ice bins receive the ice cubes when harvested.

Although several types of evaporators exist, the one of most interest to the present invention includes vertically disposed coils to which a plate bearing ice cube mold forming strips is attached. During the freezing process, water is flowed over the ice cube mold, collected in a water trough positioned beneath the evaporator and recirculated continuously first to freeze ice cubes and then to form an ice bridge interconnecting the ice cubes for harvest. During the freezing process, a splash curtain in front of the evaporator constrains the flowing water to the collection trough. Harvest is accomplished by passing hot gas from the compressor through the evaporator coils to heat the ice cube mold walls to release the ice cubes therefrom, while pushing the ice cube bearing slabs away from the evaporator for depositing the ice cubes in the ice bin. Those persons skilled in the art desiring more information concerning the evaporator and harvest probe are referred to U.S. Pat. No. 4,341,087 issued July 27, 1982, and assigned to Mile High Equipment Company.

A problem with the prior art under the counter ice making machines involves the closed compartments for and arrangement of components which necessitates complete removal of the housing unit from under the counter for maintenance and repair. Another problem is freeze cycle cut off before the ice bin is full; this problem results from use of the above-described prior art-type evaporator which harvests the ice cube bearing labs vertically. The vertically falling ice cube bearing slabs often stack vertically in the bin to the end that the bin ice cube level sensor is activated by the vertically stacked slabs prior to full bin achievement. Yet another problem is the cost of the ice making machine and increased cost of operation and maintenance.

The essential differences and advantages of the under the counter ice making machine constituting the subject matter of the present invention are as follows. First, the housing of the present invention includes a bottom compartment and a freezing compartment. The bottom compartment includes sidewalls, rear wall end, and an open front end having a grille providing an unblocked passage for the flow of air in and out of the compartment. Secondly, except for an evaporator which is located in the freezer compartment above an ice bin, the refrigerator components are housed in the bottom compartment. The freezer compartment including the ice bin is formed essentially of a unitary structure which includes the ice bin as a body portion, frame for a removable front door, sidewalls, and rear wall uprights for a top portion. The uprights of the rear wall end form a passage for an evaporator attached to a separate rear support panel. This unitary structure is supported by the bottom compartment and slidable therefrom to provide open access to the bottom compartment and top portion for maintenance and repair work to be performed on the entire refrigeration unit. Thirdly, this unitary structure reduces to a minimum the number of parts included in the housing and accordingly reduces the housing cost to a minimum. Fourthly, the removable portions of the freezer compartment body and top portions are rotocast plastic parts; thus, the costs of the bin body and top portions are substantially reduced. Fifthly, the evaporator is structured and located in the freezer compartment top portion for providing during ice cube harvest a tumbling, head over heels-type falling, action to ensure a substantially full ice bin before ice making cutoff.

SUMMARY OF THE INVENTION

Accordingly, it is an object of the present invention to provide an improved under the counter ice making machine.

Another object of the invention is to provide an under the counter ice making machine with improved operation and maintenance capabilities.

Still another object of the invention is to provide an under the counter ice making machine having an improved ice harvest capability for ensuring a substantially full ice bin before continuous freezing cycle cut off.

A further object of the invention is to provide an under the counter ice making machine which is of low cost and which is economical to manufacture using mass production techniques.

Briefly stated, the under the counter ice making machine constituting the subject matter of the invention includes a compression-type refrigerator for producing ice cube bearing slabs. A refrigerator support means includes a bottom compartment, and a rear panel extending upwardly from the bottom compartment and has the refrigerator evaporator means attached to one side adjacent a top portion thereof; the remaining refrigerator components are located in the bottom compartment.

A freezing compartment includes integrally formed body and top portions with an ice bin forming the body portion. The sidewalls of the bin extend upwardly to form the sides of the top portion. The front extends upwardly and inwardly to form a slanting door support, and a rear wall end has upright portions in sealing engagement with the sides of the evaporator supporting rear wall to complete the freezer compartment. Thus, the top portion encloses the evaporator means and is in open communication with the ice bin for ice deposit in a tumbling manner. A top panel closes the top of the freezer compartment. A removable front door mounted in the slanting front of the top compartment is slidable into the top panel for providing access to the ice bin. The bottom compartment provides support for the freezer compartment, whereby the freezer compartment without the evaporator means is removable for providing ready access to the refrigerator means without removal from under the counter for maintenance and repair.

BRIEF DESCRIPTION OF THE DRAWINGS

Other objects and features will become more readily understood from the following detailed description and appended claims when read in conjunction with the accompanying drawings in which:

DESCRIPTION OF THE PREFERRED EMBODIMENT

Figure 1:
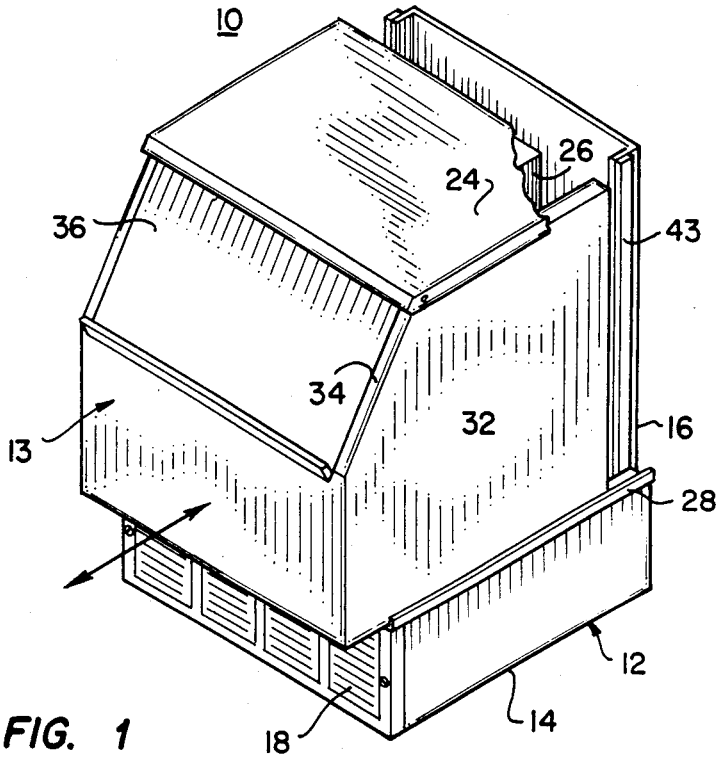
FIG. 1 is an isometric view of the under the counter ice making machine constituting the subject matter of this invention with the freezer compartment slid forward showing how it slides forward from the bottom compartment and bottom compartment rear wall extension.

Referring to FIG. 1, the under the counter ice making machine 10 includes a bottom compartment 12 and a freezer compartment 13. The bottom compartment has side panels 14, rear panel 16, and a grille 18 forming a front panel. The rear panel 16 of the bottom compartment 12 extends upwardly past a removable body (ice bin) portion 20 (FIG. 2), and top portion 22 of the freezer compartment 13 having a top panel 24. An evaporator means 26 (FIG. 8) is connected to the rear plate 16 to extend into the freezer compartment top portion 22. The body or ice bin portion has integrally formed extensions for the top portion of the freezer compartment. The housing bottom compartment 12 has flanges 28 and 30 (FIGS. 1 and 5) for slidably supporting the removable ice bin 20 (FIG. 2) and extensions of the top portion 22 integral with the ice bin. Thus, the bin has side walls 32, a front panel with upwardly and inwardly slanting uprights 34, and a rear panel with supporting uprights 35. The bin 20 corresponds to the top of the bottom compartment whereby the bin bottom acts as a partition between the bottom and freezer compartments.

The bin bottom interior surface slopes downwardly from the front and sides to a bin drain orifice 44 (FIG. 2) located adjacent to the rear wall end for drainage into a drain tank hereinafter described.

Figure 2:
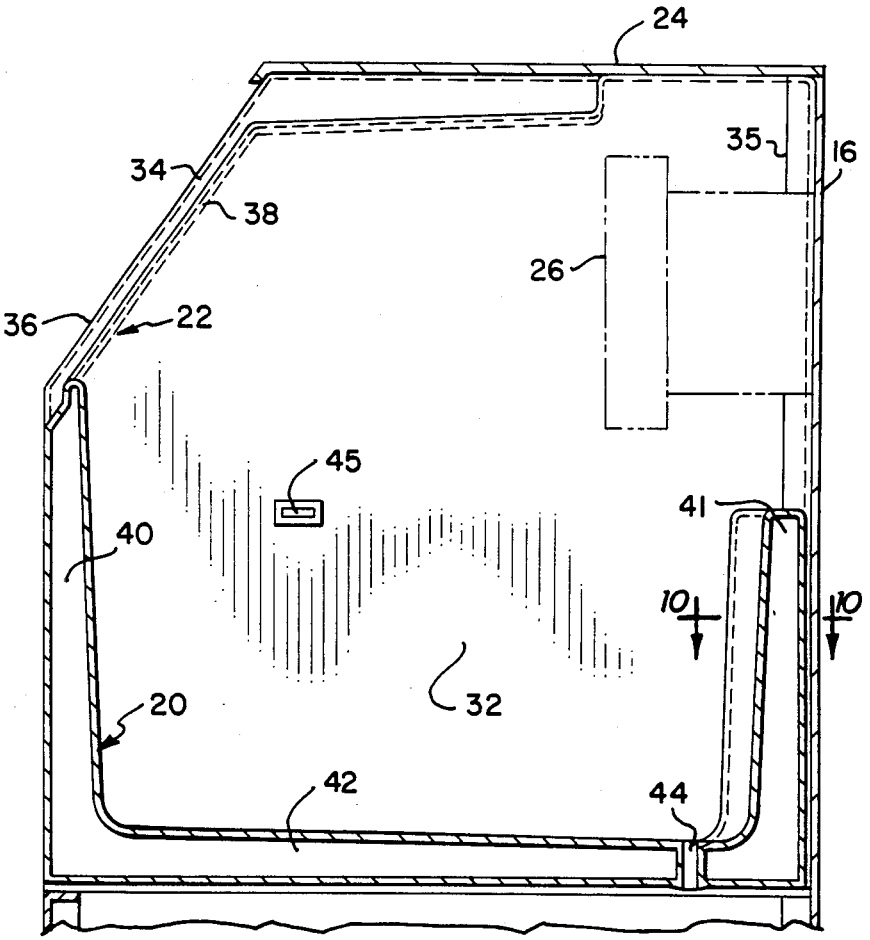
FIG. 2 is a partial side elevation view showing the bin body portion and the top portion of the housing including the sliding door guides; and with the position of the evaporator being shown schematically.
Figure 4:
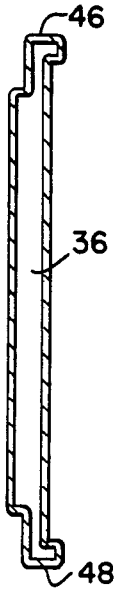
FIG. 4 is a cross-sectional view of the ice bin door taken along line 4—4 of FIG. 3.
Figure 3:
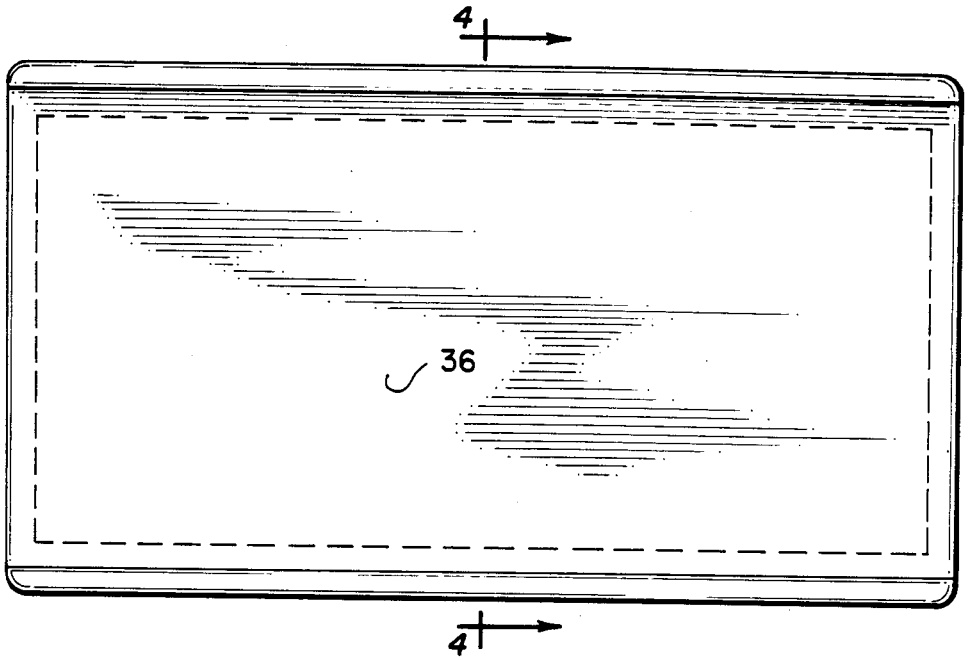
FIG. 3 is a front view of the ice bin door.

A door 36 (FIGS. 1, 3 & 4) is mounted in front panel door guides 38 of uprights 34 (FIG. 2). The door 36 together with the slanting uprights 34 forms the front of the top portion. The door guides 38 extend upwardly, parallel to the door aperture to a bend forming with the top plate a door entrance into the top portion. From the door entrance the guides extend inwardly and upwardly on, for example, a 2 degree slope a distance sufficient to accommodate the door width. The door entrance is wide enough to accommodate upward and outward rotation of the door for bringing it into alignment with the top panel for insertion into the top portion.

the door 36 (FIGS. 3 & 4), for example, is fabricated of a thermosetting plastic which includes edges 46 and 48 adapted to engage door guides 38 (FIG. 2). Thus, the door may be opened by raising it upwardly and outwardly for insertion into the door entrance along the top plate for retention while removing ice from the bin. Thereafter, the door can be pulled outwardly from the door entrance and then downwardly for closing with the bin front seat forming edge previously described. The door may be lifted from the door guide without removing any fasteners. The top panel 24 is sized to correspond to a normal counter width. While, the door 36 being positioned adjacent to the top of the bin provides ready access to the ice bin.

Figure 10:
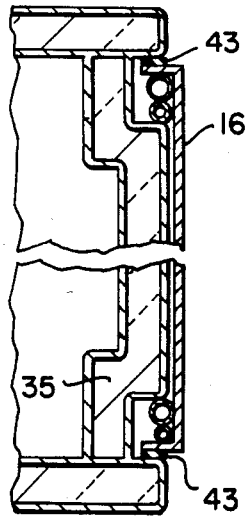
FIG. 10 is a partial sectional view taken along line 10—10 of FIG. 2 showing the freezer compartment recess and seal in engagement with the rear evaporator support panel.
Figure 5:
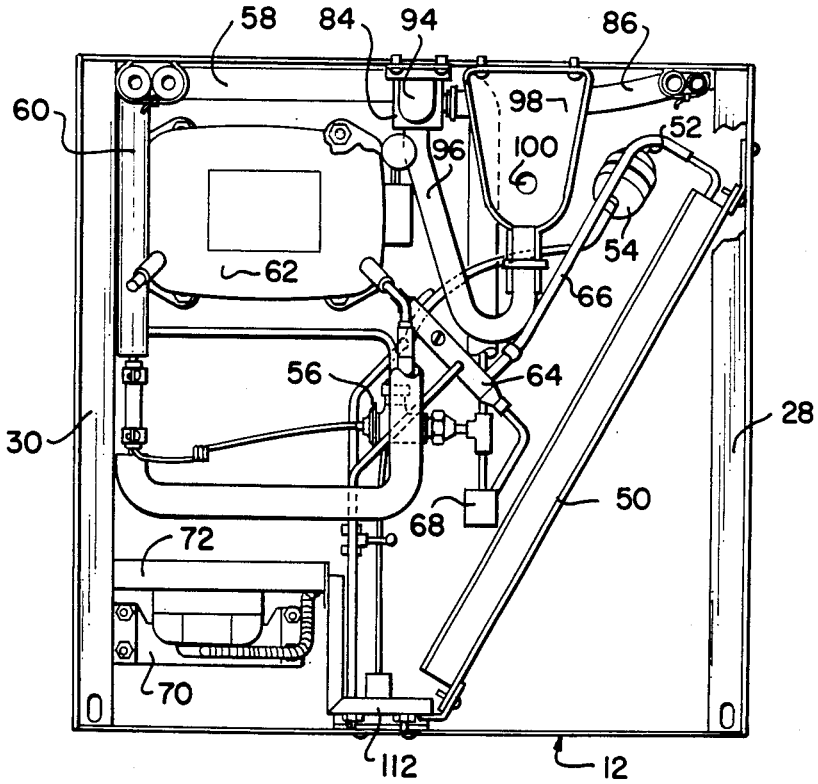
FIG. 5 is a top elevation view of the bottom compartment.

The bin and top portion integral parts are, for example, fabricated from a suitable thermosetting plastic using the rotocast process. The bin portion of the freezer compartment 13 (FIG. 2) includes front and rear hollow (insulated) walls 40 and bottom 42. The bin front hollow wall is shaped to form a seating edge for the door 36; while, the rear wall 41 recessed end uprights 35 are with seal 43 (FIG. 10) mounted in the recesses to sealingly engage the rear wall end 16 to form the freezer compartment. Corner recesses are formed in the bin rear wall and side walls rear edge portions to accommodate refrigeration piping passing from the body portion to the top portion (FIGS. 5 and 10). A temperature sensor 45 (FIG. 2) is attached in one of the side walls at an ice bin full level heighth from the bottom. When the ice bin ice cubes reach the level of the sensor, the sensor in response to the increased temperature generates a bin full indicating signal for a controller.

Figure 6:
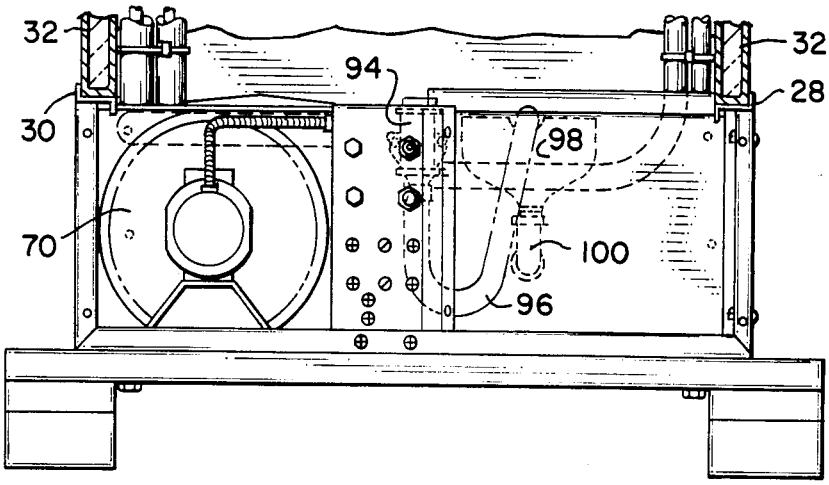
FIG. 6 is a partial front elevation view of the bottom compartment and rear panel showing the supports supporting the ice bin.
Figure 7:
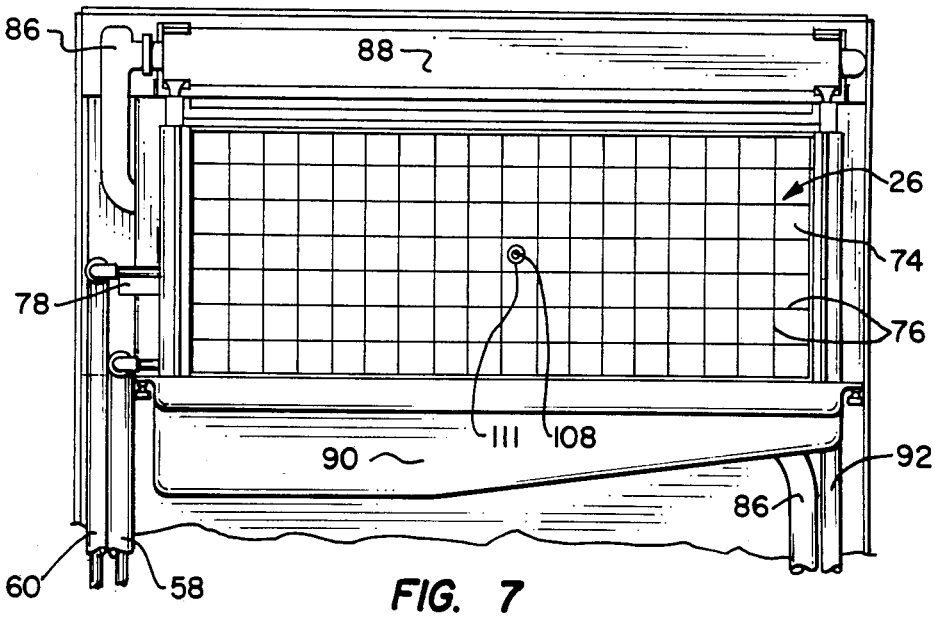
FIG. 7 is a partial front view showing the evaporator mounted on the rear panel.

Referring now to FIG. 5, the housing bottom portion compartment 12 houses the refrigerator, which may be, for example, of the compression type, having components including a condenser 50 from which high pressure liquid flows through conduit 52, and in line drier 54 to an expansion valve 56. The expansion valve converts the high pressure liquid to a low pressure liquid for passage through conduit 58 in the evaporator 26 (FIG. 7). In the evaporator, the high pressure liquid boils to become a vapor. The low pressure gas returns from the evaporator 26 through suction and heat exchanger conduit 60 to the compressor 62. Compressor 62 converts the low pressure gas to a high pressure gas and outputs it to a process header assembly 64 for return through conduit 66 to the condenser 50, and to a hot gas valve 68. Hot gas valve 68 is opened to allow hot gas to pass through conduit 58 to the evaporator 26 for harvesting the ice cubes as hereinafter described. A fan 70 (FIGS. 5 & 6) draws air through grille 18 (FIG. 1) and forces it through fan shroud 72 for cooling the condenser during the freezing operation.

The evaporator 26 (FIGS. 7 & 8) includes, for example, copper coils having ends connected to the refrigerant conduits 58 and 60. A copper plate 74 (FIG. 7) is attached by soldering, for example, to the coils, and a plurality of copper strips 76 are horizontally and vertically soldered to the front of the plate for forming an ice cube rack or mold. A passage 111 is provided in plate 74 for guiding the ice harvesting probe 108 hereinafter described. A water collection trough 90 is positioned beneath the evaporator ice cube mold. A temperature sensor 78 is also connected to the evaporator.

Figure 8:
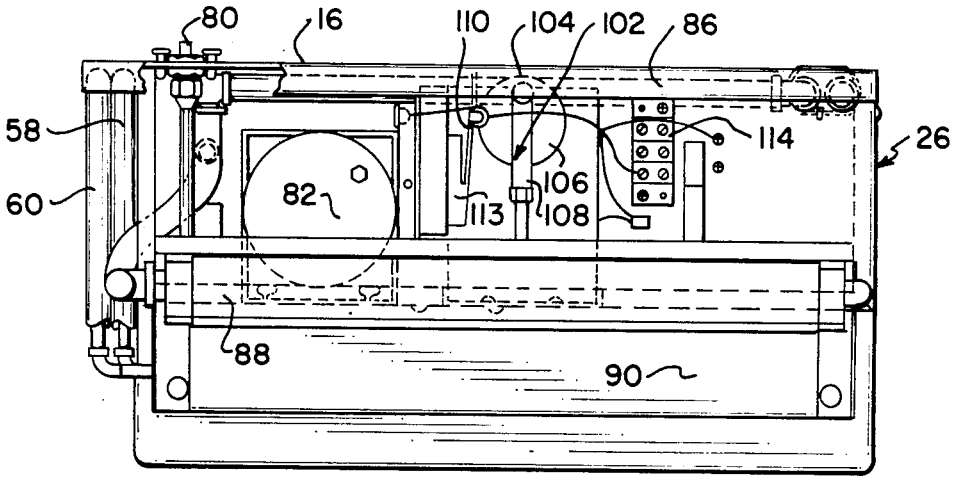
FIG. 8 is a top elevation view of the evaporator shown in FIG. 7, FIGS. 9*a* and 9*b* are, respectively, enlarged top plan and side elevational views of the harvest motor and probe mechanism for pushing the sheet of ice cubes from the mold on which it is formed in accordance with the invention.

A water supply system during the freeze cycle circulates water over the evaporator to form first ice cubes in the rack and then an ice bridge interconnecting the ice cubes. The water supply system (FIGS. 5–8) includes a water inlet pipe 80 (FIG. 8) connecting a water source to a water tank 82. A motor 84 (FIG. 5) pumps the water from the tank through pipe 86 to a water distribution tube 88 (FIGS. 7 & 8). Water distributed by the distribution tube flows over the evaporator ice cube mold into a water collection trough 90 (FIG. 7) for collection and return through pipe 92 to the water tank for recirculation. After the ice cube bearing slab has been formed and during the harvest cycle, a purge valve 94 (FIGS. 5 & 6) is operated to cut off the flow of water to the water tank, and open another valve to drain water from the tank through pipe 96 to drain tank 98 for outside drainage through pipe 100. The drainage tank 98 is positioned beneath the bin drain 44 (FIG. 2) for removing water received from the bin.

Figure 9A:
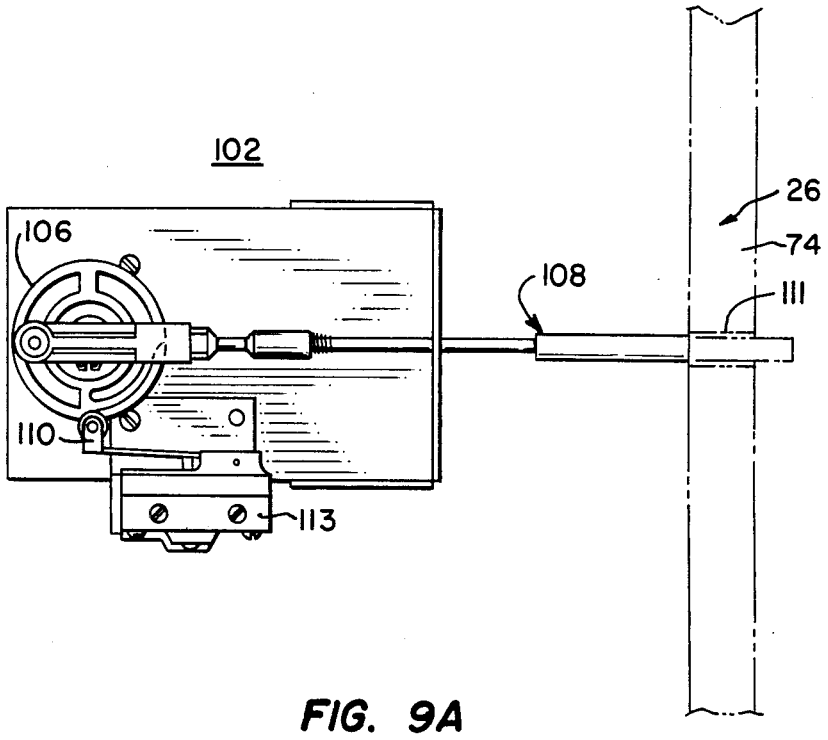
Figure 9B:
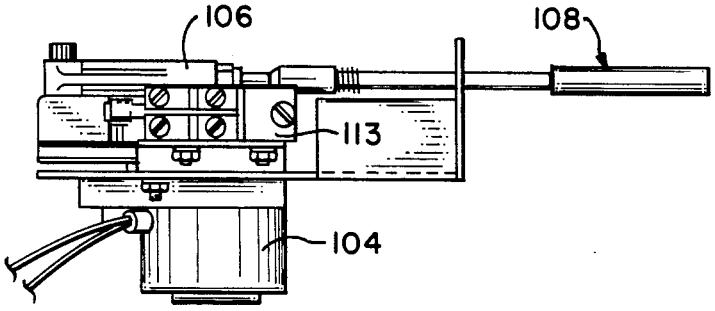

An ice cube harvest assembly 102 (FIGS. 8, 9*a* and 9*b*) includes a motor 104 for rotating a cam plate 106. An adjustable ice harvest probe 108 is eccentrically attached to the rotating cam plate for a reciprocation action and a cam follower 110 follows the cam plate. The cam and the cam follower are positioned with respect to the cam rotating plate in order that first the ice harvest probe is fully extended through a passage 111 in the evaporator copper plate 74 (FIGS. 7 and 9*a*) to disengage the ice cube bearing slab from the evaporator prior to the cam engaging the cam follower. A cam switch 111 is attached to the cam follower and closes after the probe is extended to signal harvest completion to a controller 112 (FIG. 5). In operation, the harvest probe pushes the ice slab horizontally out of the ice cube mold where it drops to the water trough which acts as a pivot to tumble the ice cube bearing slab head over heels into the ice bin to ensure a substantially full ice bin before cycle shut down. The evaporator and ice cube harvest arrangement is similar to that of the above mentioned U.S. Pat. No. 4,341,087 issued July 27, 1982. The evaporator of the patent differs in that it includes a water splash cover. A splash cover causes the sheet of ice cubes to drop vertically into the ice bin which reduces breakup and prevents more complete bin filling.

The controller 112, which is, for example, a programmable controller, controls operation of the machine. Controller 112 includes an On/Off/Wash switch, a plurality of input sensor connector circuits, and a plurality of power connector circuits. The power connector circuits include a plurality of relays 114 (FIG. 8). Thus, in response to the sensor circuits, the controller selectively actuates the relays of the power connector circuits to control the unit operation.

In operation, for example, when the selector switch is turned ON, the controller issues instructions initiating the compressor, condenser fan, and water pump to begin the freeze cycle. Ice cubes continue to be frozen until the temperature of the evaporator reaches a preselected temperature as determined by the temperature sensor such as, for example, a thermistor.

Then the controller issues an instruction to start a timer for a time freeze cycle to form an ice cube interconnecting ice bridge having a preselected thickness. At the end of the time freeze cycle, the controller issues an instruction to turn off the condenser cooling fan for a preselected time to increase the temperature of the high pressure gas from the compressor to just below its cycling temperature in harvest anticipation.

Then, the controller issues instructions to open the hot gas valve to admit hot gas to the evaporator, start the harvest motor, timer for a water purge, and activate a water purge valve for a preselected time. Upon completion of the time for water purge, the controller issues an instruction to close the water purge valve and turn off the water pump until harvest completion. With harvest completion, the harvest motor cam switch signals the controller which then issues instructions to start the freezing cycle over again absent a bin full signal. If a bin full signal is present, the controller issues suspension instructions until the bin full signal switches to indicate a fall of the ice cube level in the bin; at that time the controller issues instructions to start another freezing cycle. This operation cycle is repeated until the selector switch is turned to the OFF position. It should be apparent that the purge cycle is performed during harvest when the freezing cycle is complete. The purpose of the water purge cycle is to remove minerals rejected by ice cube formation and deposited in the water tank during the freezing cycle.

From the above description it will be obvious to one skilled in the art that an under the counter ice making machine fabricated as above described and installed under a counter can be readily cleaned, repaired, and maintained by removal of the rotocast bin and its integral top compartment parts for cleaning and for making readily available the refrigerator working parts for maintenance and repair. Further, with the top compartment design, the location of the evaporator, and the elimination of the splash curtain, the ice cube bearing slab will fall into the water trough where the horizontal push of the probe will cause it to tumble head over heels into the bin for increased breakup and more complete bin filling. Finally, the rotocast parts including the use of the bin as the compartment partition reduces substantially the cost of the machine, while maintaining the integrity of the refrigeration system.

Although only one embodiment of the invention has been described, it will be apparent to a person skilled in the art that various modifications to the details of construction shown and described may be made without departing from the scope of this invention.

What is claimed is:

1. An under the counter ice making machine comprising:

(a) a freezer compartment having a first portion, a second portion immediately above the first portion and a top panel immediately above the second portion;

(b) a bottom compartment having side panels, a front panel including a grille, and a rear panel, the rear panel having a portion extending upwardly of the bottom compartment, past the freezer compartment first and second portions to the top panel;

(c) a refrigeration means including a condenser, condenser fan, and compressor mounted in the bottom compartment and an evaporator means located in the freezer compartment second portion and attached to the extended portion of the bottom compartment rear panel for support;

(d) said first portion of the freezer compartment forming an ice bin having a bottom forming a partition between the bottom and freezer compartments, a front panel, side panels, and a rear panel, the front panel, side panels, and rear panel having freezer compartment second portion extensions forming, respectively, an upper door supporting means, side panels and top panel, and rear panel enclosing members for enclosing the upwardly extending portion of the bottom compartment rear wall; and (e) a door means including a door mounted in the upper door supporting means for completing the second portion of the freezer compartment; whereby the freezer compartment is slidably removable for cleaning the first and second portions and for exposing the refrigeration means including the evaporator for maintenance and repair.

2. An under the counter ice making machine according to claim 1 wherein the evaporator means includes an evaporator for forming vertically disposed ice cube bearing slabs and a tumbling means for harvesting the ice cubes in a head over heels manner into the ice bin for ensuring a substantially full bin.

3. An under the counter ice making machine according to claim 2 wherein the ice bin includes a temperature sensing means responsive to the surrounding ice temperature for determining a full bin.

4. An under the counter ice making machine comprising:

(a) a refrigerator means including a condenser, condenser cooling means, compressor, and evaporator means for producing ice cubes;

(b) support means for supporting the refrigerator means, said support means including bottom compartment for housing the condenser, condenser cooling means, and compressor, and a rear wall extending upwardly above the bottom compartment for supporting the evaporator means; and (c) freezer compartment means slidably mounted over the bottom compartment of the support means, said freezer compartment means including an ice bin portion and a top portion; said ice bin portion for receiving ice cubes from the evaporator means and said top portion adapted to engage the evaporator means supporting rear wall for closing the top portion with the evaporator means therein, whereby the freezer compartment means is slidably removable from the refrigerator support means thereby providing ready access to the refrigerator means for maintenance and repair.

5. An under the counter ice making machine according to claim 4 wherein the condenser cooling means is a fan, and the bottom compartment includes a front panel having a grille, said fan operatively positioned with respect to the grille for forcing air in and out of the bottom compartment for cooling the condenser.

6. An under the counter ice making machine according to claim 4 wherein the ice bin portion includes a bottom, forming a top cover for the bottom compartment when the slidable container means coacts with the evaporator rear panel support for forming the freezing compartment.

7. An under the counter ice making machine according to claim 6 wherein the freezer compartment means includes a rear wall end having a recess and a seal mounted in said recess for sealingly engaging the evaporator rear panel support for sealing the freezing compartment.

8. An under the counter ice making machine according to claim 4 wherein the freezing compartment means includes a front wall end forming the front of the ice bin and having an upwardly and inwardly apertured portion having a door guide means, and a door mounted in the guide means for providing access to the ice bin for ice cube removal.

9. An under the counter ice making machine according to claim 4 wherein the evaporator means includes a water tank means for receiving sufficient water for freezing an ice cube bearing slab, a water distribution means operatively connected to the water tank, a water pump for pumping the water from the tank to the distribution means for distribution, an evaporator having a vertically disposed ice cube mold responsive to the distributed water for forming an ice cube bearing slab, and a water trough means for collecting water leaving the mold and returning it to the water tank for recirculation.

10. An under the counter ice making machine according to claim 9 further including a water purging means operatively connected to the water tank for purging water from the water tank.

11. An under the counter ice making machine according to claim 9 wherein the evaporator means includes a harvest probe means coacting with the water trough for tumbling the ice cube bearing slab into the ice bin, said harvest probe means having a harvest completed signaling means for indicating removal of the ice cube bearing slab.

12. An under the counter ice making machine according to claim 4 further including a controller means having sensor connector circuits for connecting sensor outputs to the controller, and power connector circuits operatively connected to the controller for selectively powering the refrigerator means in response to controller operation signals.

* * * * *